US011286700B2

(12) United States Patent
Tomisawa

(10) Patent No.: US 11,286,700 B2
(45) Date of Patent: Mar. 29, 2022

(54) SAFETY DEVICE FOR SLIDING DOOR

(71) Applicant: TOK, INC., Tokyo (JP)

(72) Inventor: Toshiki Tomisawa, Tokyo (JP)

(73) Assignee: TOK, INC., Tokyo (JP)

( * ) Notice: Subject to any disclaimer, the term of this patent is extended or adjusted under 35 U.S.C. 154(b) by 4 days.

(21) Appl. No.: 17/048,066

(22) PCT Filed: Mar. 22, 2019

(86) PCT No.: PCT/JP2019/012048
§ 371 (c)(1),
(2) Date: Oct. 15, 2020

(87) PCT Pub. No.: WO2019/202910
PCT Pub. Date: Oct. 24, 2019

(65) Prior Publication Data

US 2021/0172231 A1 Jun. 10, 2021

(30) Foreign Application Priority Data

Apr. 18, 2018 (JP) ..... JP2018-080262

(51) Int. Cl.
*E05F 5/00* (2017.01)
*E06B 7/36* (2006.01)

(52) U.S. Cl.
CPC ..... *E05F 5/003* (2013.01); *E06B 7/36* (2013.01); *E05Y 2201/412* (2013.01);
(Continued)

(58) Field of Classification Search
CPC ..... E05F 5/003; E06B 7/36; E05Y 2201/412; A47B 88/473; A47B 88/477; A47B 88/53
See application file for complete search history.

(56) References Cited

U.S. PATENT DOCUMENTS 3,796,405 A * 3/1974 Rystad ..... E06B 3/02 248/489
4,989,296 A * 2/1991 Alderson ..... E05D 15/0634 16/105

(Continued)

FOREIGN PATENT DOCUMENTS

JP H11152955 6/1999
JP 2006002346 1/2006

(Continued)

OTHER PUBLICATIONS

International Search Report for corresponding International Application No. PCT/JP2019/012048, dated Jun. 4, 2019; 2 pages.

*Primary Examiner* — Jeffrey O'Brien
(74) *Attorney, Agent, or Firm* — Fattibene and Fattibene LLC; Paul A. Fattibene

(57) ABSTRACT

[Problem] To provide a safety device for a sliding door with which finger pinching can be automatically prevented without manually operating a stopper, and which can be smoothly closed without a resistance that acts when closing the sliding door. [Solution] A safety device for a sliding door is provided with a guide frame 11 and a feed plate 12 that are mounted on the opening side and the sliding door side, respectively, so as to face each other. A low-speed movement groove 38*a* and a lock groove 38*b* are provided on the guide frame 11 side. A contact face 12*c* that is inclined to contact a disk roller is provided on the feed plate 12 side. In addition, when the feed plate 12 collides with the disk roller 14 at a force stronger than or equal to a prescribed value, the shaft 14*b* of the disk roller 14 is moved from inside the low-speed movement groove 38*a* to inside the lock groove 38*b* and the movement of the disk roller 14 in the left-right direction is locked.

10 Claims, 13 Drawing Sheets

(52) U.S. Cl.
CPC ... *E05Y 2201/688* (2013.01); *E05Y 2800/296* (2013.01); *E05Y 2800/41* (2013.01)

(56) References Cited

U.S. PATENT DOCUMENTS

| | | | | |
|---|---|---|---|---|
| 8,915,019 | B2 * | 12/2014 | Schachter | E05D 5/0246 49/425 |
| 8,919,897 | B2 * | 12/2014 | Chen | E05D 15/0686 312/334.44 |
| 2007/0101540 | A1 * | 5/2007 | Martin | E05D 15/0634 16/97 |
| 2011/0072614 | A1 * | 3/2011 | Luedke | E05D 15/0634 16/97 |
| 2014/0026358 | A1 * | 1/2014 | Saito | E05F 5/003 16/72 |

FOREIGN PATENT DOCUMENTS

| | | |
|---|---|---|
| JP | 2009097323 | 5/2009 |
| JP | 2009203663 | 9/2009 |
| JP | 2010196392 | 9/2010 |
| JP | 2011184961 | 9/2011 |

* cited by examiner

SAFETY DEVICE FOR SLIDING DOOR

TECHNICAL FIELD

The present invention relates to safety devices for sliding doors and, in particular, to a safety device for a sliding door which opens and closes to left and right, the device for preventing a finger or the like from being injured because of being caught between a frame on an opening side and a frame on a sliding door side when the sliding door is opened and closed.

BACKGROUND ART

In general, as a sliding door which opens and closes to left and right, a double sliding door, a single sliding door, and so forth have been known. These sliding doors have a problem in which a finger or the like is inadvertently injured because of being caught between a frame on an opening side and a frame on a sliding door when the sliding door is opened and closed.

Thus, various safety device have been suggested for preventing a finger or the like from being injured because of being caught between the frame on the opening side and the frame on the sliding door side when the sliding door is opened and closed, and can be known from, for example, PTL 1 and PTL 2.

In the safety device described in PTL 1, a stopper with its tip protruding when falling down onto a running passage of the sliding door is assembled to a frame on a substrate side so as to be able to rise and fall. The stopper is caused to fall down as required to restrict movement of the sliding door, preventing a finger tip from being pinched between the sliding door and the frame.

The safety device described in PTL 2 includes a main body formed so as to be attachable to a portion near a rear end of an upper part of a sliding door, a spiral spring provided to that main body to accumulate repulsive forces to a closing direction with movement of the sliding door to an opening direction, a rotatable main gear consecutively linked to that spiral spring, an oil dumper provided adjacently to the spiral spring to control the repulsive forces of the spiral spring by rotation of a sub-gear engaged with the main gear, a rack engaged with the main gear and having a rear end or both front and rear ends attached to a fixture of a frame body B of an opening A to be spread to a running direction of the sliding door. By the oil dumper, movement to a closing direction is controlled so that the sliding door is not abruptly closed, thereby preventing a finger tip from being caught.

CITATION LIST

Patent Literatures

PTL 1: Japanese Unexamined Patent Application Publication No. 2006-2346

PTL 2: Japanese Unexamined Patent Application Publication No. 11-152955

SUMMARY OF INVENTION

Technical Problem

As described above, in the invention described in PTL 1, the stopper has to be manually made stand or fall down. Thus, there are problems in which the task is cumbersome and is performed, with a switching task forgotten, in a dangerous state due to in which the safety device does not work.

On the other hand, in the invention described in PTL 2, since the oil dumper is used, when the sliding door is closed, there is a problem in which resistance of the oil dumper works and requires closing with a large force.

Thus, a technical problem to be solved arises in order to provide a safety device for a sliding door, the device automatically preventing pinching of a finger or the like even without manual operation of the stopper and allowing the sliding door to be smoothly closed without resistance acting when the sliding door is closed. An object of the present invention is to solve this problem.

Solution to Problem

The present invention is suggested to achieve the above-described object, and the invention described in an embodiment provides a safety device for a sliding door capable of making to-and-fro movements for covering and uncovering an opening, the device including a guide frame and a feed plate to be separately attached to the opening side and the sliding door side so as to be opposed to each other, wherein the guide frame includes a guide main body formed to have a C-shaped cross section having an upper wall part connecting and fixing paired front and rear side wall plate parts and upper end sides of the paired front and rear side wall plate parts and being provided with a guide passage where the feed plate passes between the paired side wall plate parts, a restriction groove provided to each of the paired front and rear side wall plate parts and having a slow movement groove provided to extend in a left-right direction along a direction of movement of the sliding door and a lock groove consecutively connected to the slow movement groove and having a stopper part, and a disk roller having a disk part and a shaft part longitudinally penetrating through a center of the disk part to be integrated with the disk part, with the shaft part being movably engaged inside the restriction grooves in a left-right direction and the disk part being placed to protrude inside the guide passage, and the feed plate includes a contact face which, when colliding with the disk part with a predetermined strength or more, moves the shaft part from inside of the slow movement groove to the stopper part of the lock groove to lock movement of the disk roller in the left-right direction and inhibit the feed plate from moving together with the sliding door to a closing side.

According to this structure, when the sliding door is normally slowly closed to cause the contact face of the feed plate and the outer peripheral surface of the disk part in the disk roller abut on each other, the disk roller is guided in the slow movement groove to roll and move to a closing direction of the sliding door (substantially horizontal direction: A direction). This causes the feed plate also to be moved together with the disk roller to the closing direction of the sliding door, thereby allowing the sliding door to be completely closed. On the contrary, when the sliding door is started to be closed vigorously, the contact face of the feed plate collides with the outer peripheral surface of the disk part in the disk roller vigorously with a predetermined strength or more, and the disk roller is moved to a direction (C direction) of a resultant vector of the closing direction of the sliding door (substantially horizontal direction: A direction) and a direction orthogonal to the contact face of the feed plate (B direction) and the shaft part is moved from the inside of the slow movement groove to the inside of the lock groove. Then, the disk roller moves along the lock groove of the guide frame and is soon nipped between the stopper part of the lock groove and the contact face of the feed plate to become in a lock state, automatically inhibiting further movement of the feed plate to the closing side together with the sliding door. This can prevent a finger or the like from being inadvertently caught in opening/closing operation of the sliding door and prevent the occurrence of a large noise.

The invention described in another embodiment provides the safety device for the sliding door in which, in the structure described in a prior embodiment, the contact face is formed as a tilted surface rising from a front side of a moving direction of the feed plate toward a rear side of the moving direction.

According to this structure, when the sliding door is started to be closed vigorously, the contact face of the feed plate collides with the outer peripheral surface of the disk part in the disk roller vigorously with a predetermined strength or more, and the disk roller is moved smoothly to the direction (C direction) of the resultant vector of the closing direction of the sliding door (substantially horizontal direction: A direction) and the direction orthogonal to the tilted contact face of the feed plate (B direction) and the shaft part is smoothly moved from the inside of the slow movement groove to the stopper part.

The invention described in another embodiment provides the safety device for the sliding door in which, in the structure described in a prior embodiment, the slow movement groove of the restriction groove is formed as a slit-shaped groove, and the lock groove of the restriction groove is tilted at a predetermined angle from the opening side toward a closing side of the slow movement groove.

According to this structure, when the lock groove is provided to be tilted with respect to the slow movement groove, the contact face of the feed plate collides with the outer peripheral surface of the disk part in the disk roller vigorously with a predetermined strength or more. When the disk roller escapes to the direction (C direction) of the resultant vector of the closing direction of the sliding door (substantially horizontal direction: A direction) and the direction orthogonal to the tilted contact face of the feed plate (B direction), the shaft part can be guided toward the stopper part by the tilted face provided in the lock groove and reliably locked.

The invention described in another embodiment provides the safety device for the sliding door in which, in the structure described in a prior embodiment, the stopper part restricts movement of the shaft part of the disk roller to the closing side of the sliding door.

According to this structure, the shaft part moved toward the inside of the lock groove can be reliably stopped by the stopper part and can be reliably locked always at a determined position.

The invention described in another embodiment provides the safety device for the sliding door in which, in the structure described in a prior embodiment, the lock groove is formed as a long hole connected to the stopper part and as a curved surface swelling outside away from the slow movement groove.

According to this structure, with the long hole of the lock groove formed as a curved surface swelling outside away from the slow movement groove, as for the disk roller, if there is a design error between the direction (C direction) of the resultant vector of the closing direction of the sliding door (substantially horizontal direction: A direction) and the direction orthogonal to the tilted contact face of the feed plate (B direction) and the orientation of the lock groove, the error is absorbed by that curved surface, and the disk roller can be smoothly moved to the inside of the lock groove to be reliably locked.

The invention described in another embodiment provides the safety device for the sliding door in which, in the structure described in a prior embodiment, the lock groove is formed to be as one of bifurcating branches including the slow movement groove.

According to this structure, it is possible to make a configuration such that, when the disk roller is moved to the closing direction and the shaft part is once locked at the stopper part inside the lock groove, locking is not released unless the feed plate is returned to the opening direction until the feed plate is disconnected from the lock groove together with the disk roller. Thus, locking can be reliably made.

The invention described in another embodiment provides the safety device for the sliding door in which, in the structure described in a prior embodiment, the stopper part of the lock groove is formed in a step shape with respect to the slow movement groove.

According to this structure, to release the state in which the disk roller is moved to the closing direction and the shaft part of the disk roller is locked inside the lock groove, when the abutting force between the contact face of the feed plate and the disk part of the disk roller is released, the shaft part is disconnected from the stopper part of the lock groove to be returned to the inside of the slow movement groove, and locking can be easily released to allow movement again to the closing direction.

The invention described in another embodiment provides the safety device for the sliding door in which, in the structure described in a prior embodiment, the restriction groove includes a closing-direction end groove which lets the disk roller escape to a direction away from the feed plate when the feed plate is moved to a predetermined position with respect to the guide frame to allow movement of the feed plate further to a closing direction, and an opening-direction end groove which lets the disk roller escape to the direction away from the feed plate when the feed plate is returned to a predetermined position with respect to the guide frame to allow movement of the feed plate further to an opening direction.

According to this structure, the sliding door is allowed to be moved by the feed plate from the inside of the guide frame to a closing position and then returned again to an opening position with the feed plate passing through the inside of the guide frame.

The invention described in another embodiment provides the safety device for the sliding door in which, in the structure described in a prior embodiment, the restriction groove includes a disk roller retreat groove which causes the disk roller to be retreated and retained outside the guide passage.

According to this structure, when the safety device is not required, the disk roller is let escape to the inside of the disk roller retreat groove to be placed outside the guide passage. This makes the safety device invalid, and allows usage so that the feed plate does not collide with the disk roller even if passing through the inside of the guide passage. On the other hand, when the safety device is required, the disk roller is returned from the inside of the disk roller retreat groove to the slow movement groove, thereby causing the safety device to be returned to a valid state again for use.

The invention described in another embodiment provides the safety device for the sliding door in which, in the structure described in a prior embodiment, the paired front and rear side wall plate parts and the upper wall part of the guide main body are each formed as a separate body.

According to this structure, the paired front and rear side wall plate parts and the upper wall part of the guide main body can be each formed individually, and thus manufacturing becomes facilitated. Also, they are each formed as a separate member, which facilitates designing and also facilitating assembling of the guide main body and the disk roller.

Advantageous Effects of Invention

According to this structure, when the sliding door is started to be closed vigorously, the contact face of the feed plate collides with the outer peripheral surface of the disk part in the disk roller vigorously with a predetermined strength or more, and the disk roller is moved to a direction (C direction) of a resultant vector of the closing direction of the sliding door (substantially horizontal direction: A direction) and a direction orthogonal to the contact face of the feed plate (B direction), the shaft part is moved from the inside of the slow movement groove to the inside of the stopper part of the lock groove, and the disk roller is soon nipped between the stopper part of the lock groove and the contact face of the feed plate to automatically become in a lock state, inhibiting further movement of the feed plate to the closing side together with the sliding door. Thus, it is possible to prevent a finger or the like from being inadvertently caught in opening/closing operation of the sliding door and prevent the occurrence of a large noise.

BRIEF DESCRIPTION OF DRAWINGS

FIGS. 7A-C depicts diagrams of describing operation of the safety device for the sliding door depicted as the above first embodiment, in which FIG. 7A is a diagram depicting a state in which a start is initiated toward a closing side and the feed plate and a disk roller abut on each other, FIG. 7B is a diagram depicting a state in which the feed plate and the disk roller are moved to a fully-closed position, and FIG. 7C is a diagram depicting a state in which the feed plate and the disk roller are locked in the course of going toward the fully-closed position.

FIGS. 12A-C depicts diagrams of describing operation of the safety device for the sliding door depicted as the above second embodiment, in which FIG. 12A is a diagram depicting a state in which a start is initiated toward a closing side and the feed plate and a disk roller abut on each other, FIG. 12B is a diagram depicting a state in which the feed plate and the disk roller are moved to the fully-closed position, and FIG. 12C is a diagram depicting a state in which the feed plate and the disk roller are locked in the course of going toward the fully-closed position.

FIGS. 17A-D depicts diagrams of describing operation of the safety device for the sliding door depicted as the above third embodiment, in which FIG. 17A is a diagram depicting a state in which a start is initiated toward a closing side and the feed plate and a disk roller abut on each other, FIG. 17B is a diagram depicting a state in which the disk roller is moved to a termination end position and the feed plate is in the course of further going toward the fully-closed position, and FIG. 17C is a diagram depicting a state in which the disk roller is placed after the feed plate is moved to the fully-closed position, and FIG. 17D is a diagram depicting a state in which the feed plate and the disk roller are locked in the course of going toward the fully-closed position.

FIGS. 18A-C diagrams of describing operation of the safety device for the sliding door depicted as the above third embodiment, in which FIG. 18A is a diagram depicting a state in which movement is made from a closing side to an open side and the feed plate and the disk roller abut on each other, FIG. 18B is a diagram depicting a state in which the feed plate is in the course of going through a lower side of the disk roller to the open side, and FIG. 18C is a diagram depicting a state after the feed plate is moved through the lower side of the disk roller to the open side.

DESCRIPTION OF EMBODIMENTS

Figure 1:
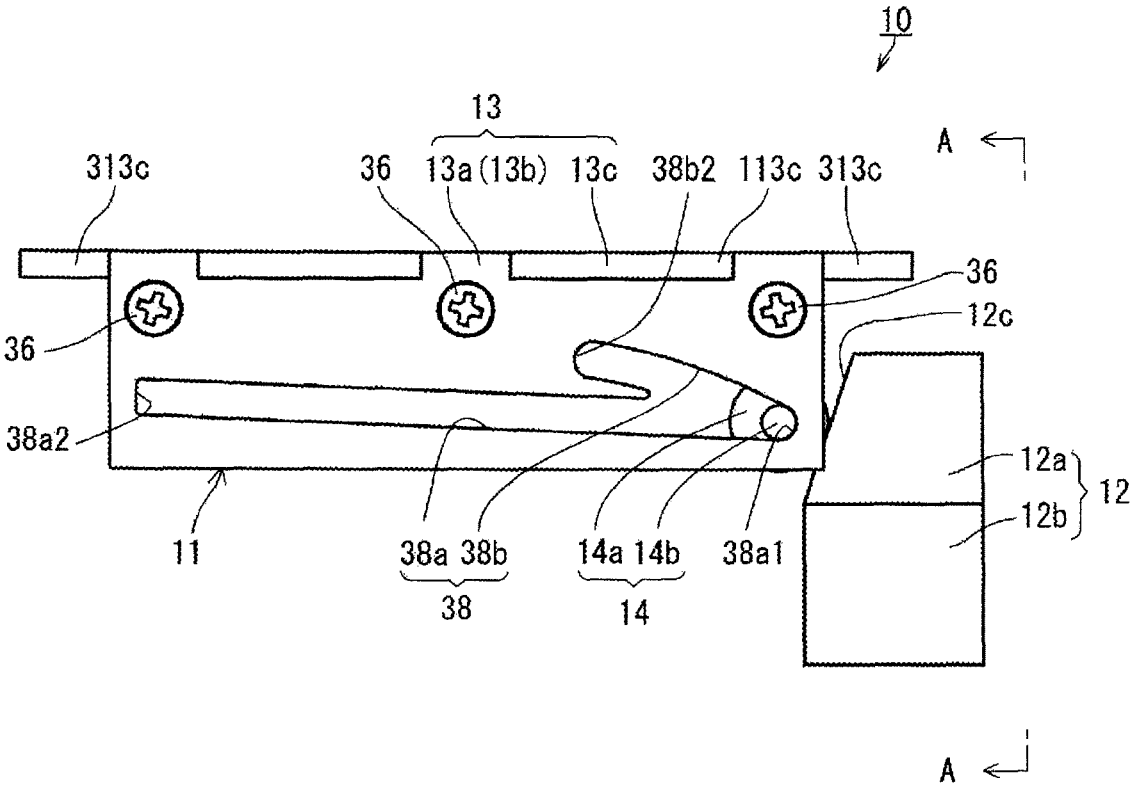
FIG. 1 is a side view of a safety device for a sliding door depicted as a first embodiment of the present invention viewed from a front side.

To achieve the object of providing a safety device for a sliding door, the device automatically preventing pinching of a finger or the like even without manual operation of the stopper and allowing the sliding door to be smoothly closed without resistance acting when the sliding door is closed, a safety device for a sliding door capable of making to-and-fro movements for covering and uncovering an opening is achieved by configuring the device so that the device includes a guide frame and a feed plate to be separately attached to the opening side and the sliding door side so as to be opposed to each other, wherein the guide frame includes a guide main body formed to have a C-shaped cross section having an upper wall part connecting and fixing paired front and rear side wall plate parts and upper end sides of the paired front and rear side wall plate parts and being provided with a guide passage where the feed plate passes between the paired side wall plate parts, paired front and rear restriction grooves respectively provided to the paired front and rear side wall plate parts and each having a slow movement groove provided to extend in a left-right direction along a direction of movement of the sliding door and a lock groove consecutively connected to the slow movement groove and having a stopper part, and a disk roller having a disk part and a shaft part longitudinally penetrating through a center of the disk part to be integrated with the disk part, with the shaft part being movably engaged inside the paired front and rear slow movement grooves in a left-right direction and the disk part being placed to protrude inside the guide passage, and the feed plate includes a contact face which, when colliding with the disk part of the disk roller with a predetermined strength or more, moves the shaft part of the disk roller from inside of the slow movement groove to the stopper part of the lock groove to lock movement of the disk roller in the left-right direction and inhibit the feed plate from moving together with the sliding door to a closing side.

In the following, embodiments for implementing the present invention are described in detail based on the attached drawings. Note that, in the following description, the same component is provided with the same reference character throughout the entire description of the embodiments. Also, representations such as front-rear, up-down, left-right, and so forth indicating directions are not meant to be absolute, and are appropriate in an orientation in which each part of the safety device for the sliding door of the present invention is rendered but, when that orientation changes, should be construed as being changed in accordance with the change of the orientation.

Embodiments

Figure 2:
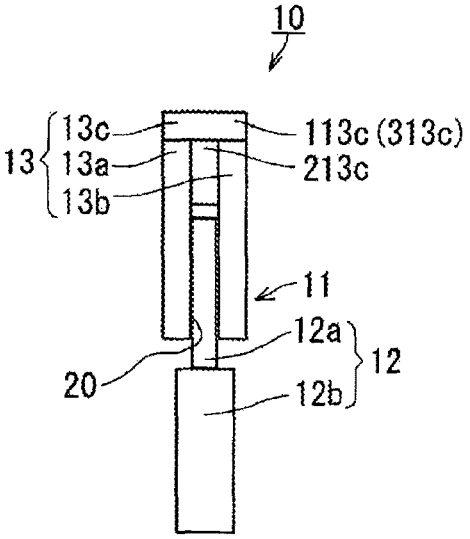
FIG. 2 is a side view of the safety device for the sliding door depicted as the above first embodiment viewed from a direction of an A-A line in FIG. 1.
Figure 3:
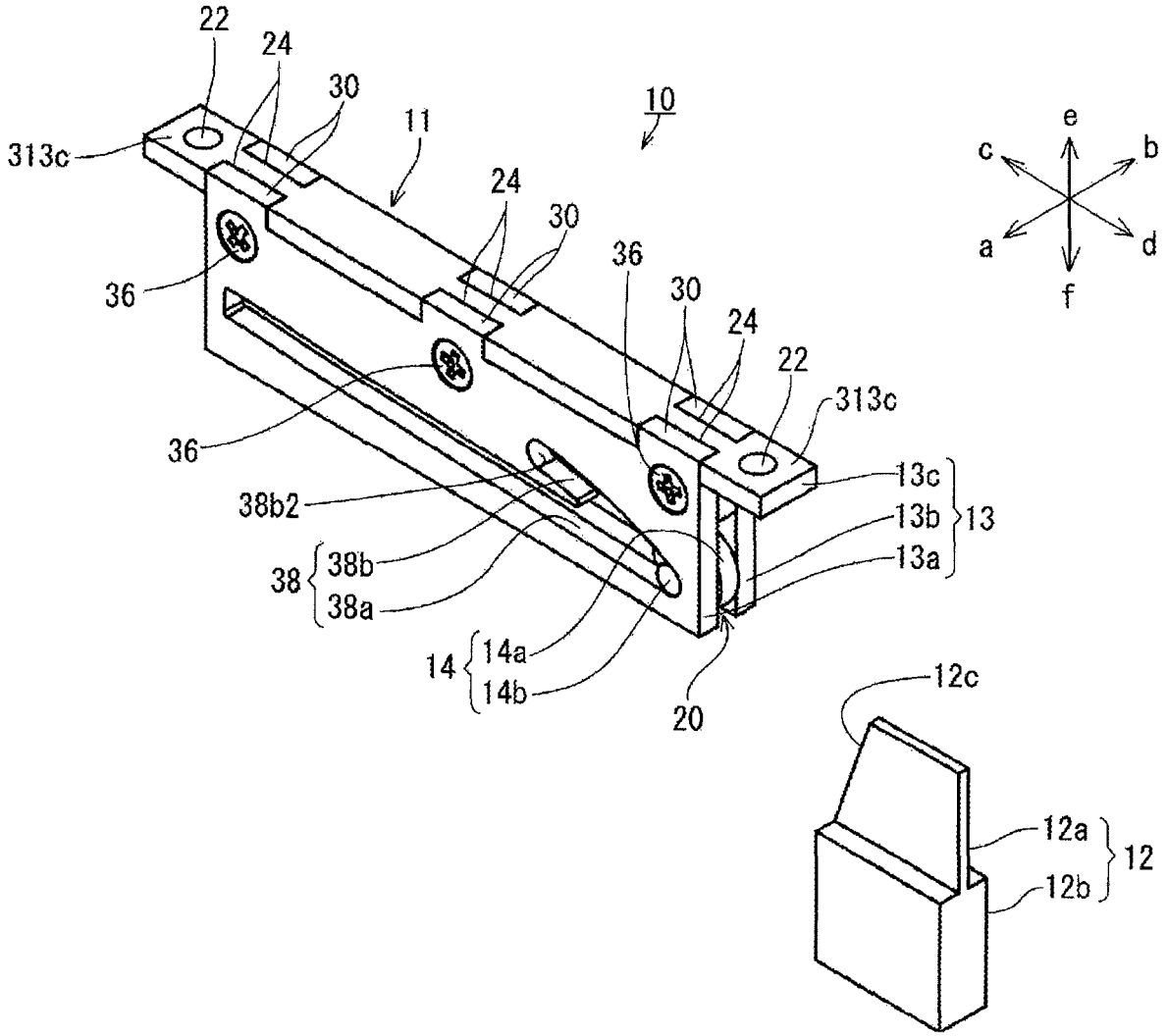
FIG. 3 is an external perspective view of the safety device for the sliding door depicted as the above first embodiment.
Figure 4:
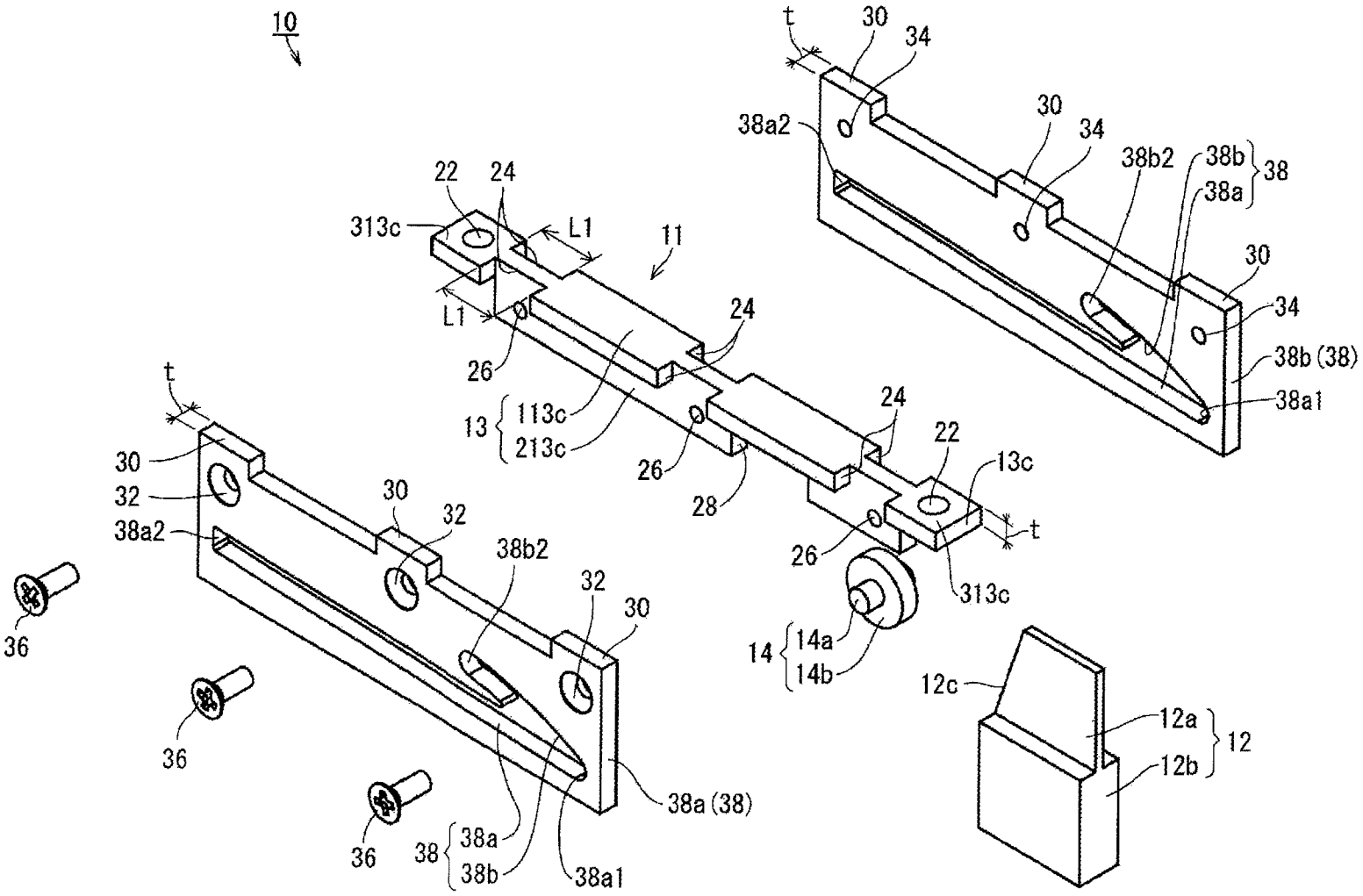
FIG. 4 is an exploded perspective view of the safety device for the sliding door depicted as the above first embodiment.

FIG. 1 to FIG. 4 depict a first embodiment of a safety device 10 for a sliding door (hereinafter simply referred to as a safety device 10) according to the present invention. FIG. 1 is a side view of the safety device 10 viewed from the front, FIG. 2 is a side view of the safety device 10 viewed from a direction of an A-A line of FIG. 1, FIG. 3 is an external perspective view of the safety device 10, and FIG. 4 is an exploded perspective view of the safety device 10. In the following description, description is made by taking, in FIG. 3, an arrow a-b direction as a front-rear direction of the safety device 10, an arrow c-d direction as a left-right direction of the safety device 10, and an arrow e-f direction as an up-down direction of the safety device 10. Also, description is made by taking an arrow c direction as a fully-closed position side, an arrow d direction as a fully-open position side, and, furthermore, a surface depicted in FIG. 1 as a front side.

In FIG. 1 to FIG. 4, the safety device 10 is configured of a guide frame 11 to be attached to an appropriate place of an upper frame body forming an opening of a door, window, or the like not depicted and a feed plate 12 to be attached to an appropriate place of a sliding door, also not depicted, covering and uncovering the opening. Note that, depending on the use mode, the guide frame 11 may be attached to a sliding door side and the feed plate 12 may be attached to a frame body side of the sliding door. In any case, the guide frame 11 and the feed plate 12 are attached at appropriate positions so as to be opposed to each other and also be able to slide and engage with each other.

The guide frame 11 includes a guide main body 13 and a disk roller 14 incorporated in the guide main body 13.

The guide main body 13 has paired front and rear side wall plate parts 13*a* and 13*b* and an upper wall part 13*c* connecting upper end sides of the paired front and rear side wall plate parts 13*a* and 13*b*, and is provided with a guide passage 20 where the feed plate 12 passes between the paired front and rear side wall plate parts 13*a* and 13*b* to form a C-shaped cross section in a side view.

The upper wall part 13*c* has, as depicted in FIG. 4 (and FIG. 2, FIG. 3), a horizontal attachment plate part 113*c* and a vertical plate part 213*c* vertically dropping from the center of the horizontal attachment plate part 113*c* in an integrated manner, thereby being formed in a T shape in a side view.

Provided on both left and right end sides of the horizontal attachment plate part 113*c* in the upper wall part 13*c* are plate-shaped attachment seat parts 313*c*, 313*c* formed to be extended from the vertical plate part 213*c* further to the left-right direction (the arrow c-d direction in FIG. 3). In each of the attachment seat parts 313*c*, 313*c*, a vertically penetrating attachment hole 22 is formed.

Furthermore, in the horizontal attachment plate part 113*c*, three notched parts 24 are substantially equidistantly formed at positions on each of both front and rear sides across the vertical plate part 213*c* so as to be separated in the left-right direction. Note that the width of each notched part 24 in the left-right direction is L1. Also, the amount of notching of the notched part 24 from both front and rear sides is substantially equal to a plate thickness t of the side wall plate parts 13*a* and 13*b* (refer to FIG. 4), and thus the notched part 24 is formed to be notched to a position in contact with the vertical plate part 213*c*.

The vertical plate part 213*c* has attachment holes 26 substantially equidistantly formed to penetrate to a front-rear direction. Also, the vertical plate part 213*c* has a notched part 28 formed from a lower end side toward an upper end side (upper wall part 13*c* side). The position of the notched part 28 substantially corresponds to a lock position (stopper part 38*b*2) of a lock groove 38*b* in a restriction groove 38, which will be described further below. The notched part 28 forms a space for letting the disk roller 14 moved upward (an arrow e direction) in the lock groove 38*b* escape to the upper wall part 13*c* side without colliding with the vertical plate part 213*c*.

The paired front and rear side wall plate parts 13*a* and 13*b* are formed in substantially symmetrical shapes. On an upper end side of each of these paired front and rear side wall plate parts 13*a* and 13*b*, convex parts 30 are provided correspondingly to the notched parts 24 of the upper wall part 13*c*. Each convex part 30 is formed to have the width L1 in the left-right direction equal to the width L1 of each notched part 24 of the upper wall part 13*c* in the left-right direction, and is formed to have an amount of upward protrusion substantially equal to the plate thickness t of the upper wall part 13*c*. This allows the convex parts 30 of the paired side wall plate parts 13*a* and 13*b* to closely fit in the respective notched parts 24 of the upper wall part 13*c*, and the inner surfaces of the paired side wall plate parts 13*a* and 13*b* make close contact with both surfaces of the vertical plate part 213*c*. Therefore, when the paired front and rear side wall plate parts 13*a* and 13*b* and the upper wall part 13*c* are combined, as depicted in FIG. 2 and FIG. 3, the guide passage 20 with its lower side and both left and right sides open is formed between the paired front and rear side wall plate parts 13*a* and 13*b*.

Also, of the paired front and rear side wall plate parts 13*a* and 13*b*, the front-side side wall plate part 13*a* is provided with attachment holes 32 correspondingly to respective attachment holes 26 of the vertical plate part 213*c* in the upper wall part 13*c*, and the rear-side side wall plate part 13*b* is provided with attachment holes 34 correspondingly to the respective attachment holes 26 of the vertical plate part 213*c* in the upper wall part 13*c*. And, in a state in which the paired front and rear side wall plate parts 13*a* and 13*b* and the upper wall part 13*c* are combined, when attachment screws 36 are screwed from a side wall plate part 13*a* side sequentially through the attachment holes 32 and the attachment holes 26 side into the attachment holes 34 to be fastened and fixed, the paired front and rear side wall plate parts 13*a* and 13*b* and the upper wall part 13*c* can be integrally fixed.

Furthermore, in each of the paired front and rear side wall plate parts 13*a* and 13*b*, a restriction groove 38 is formed in a substantially symmetrical shape and in a state of being hollowed in the front-rear direction.

The restriction groove 38 is configured of: a slow movement groove 38*a* formed as a long-hole groove provided to extend along a direction of movement of the sliding door, that is, the left-right direction (the arrow c-d direction in FIG. 3); and a lock groove 38*b* consecutively connected to the slow movement groove 38*a*, in a state of being as one of bifurcating branches from the root of the slow movement groove 38*a*, and formed as a long hole.

Figure 5:
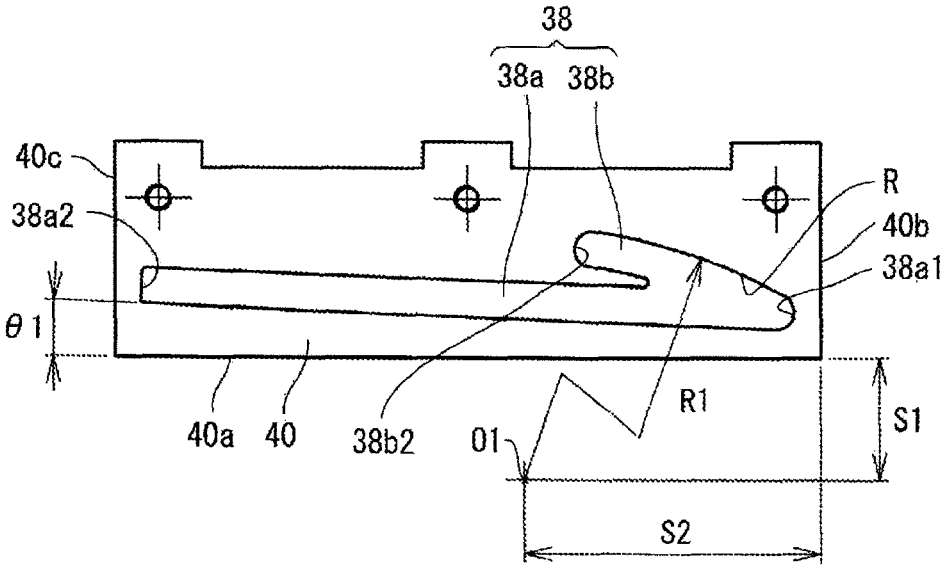
FIG. 5 is a diagram describing a detailed structure of a guide frame in the safety device for the sliding door depicted as the above first embodiment.

The slow movement groove 38*a* is formed, as depicted in FIG. 5, so as to be tilted with respect to a lower side 40 of the paired front and rear side wall plate parts 13*a* and 13*b* as rising from a fully-open side (an arrow d side in FIG. 3) toward a fully-closed side (an arrow c side in FIG. 3) and have an angle θ1. Note that the angle θ1 in the present embodiment is substantially 2.19 degrees.

Similarly as depicted in FIG. 5, the lock groove 38*b* is formed as a curved surface R arcing continuously from an opening-direction end 38*a*1 of the slow movement groove 38*a*. Note that the arcuate curved surface R is formed as the curved surface R having a curvature substantially equal to that of a circle rendered as having a radius R1 by taking, as a center O1, a point away downward from a lower side 40*a* of the paired front and rear side wall plate parts 13*a* and 13*b* by a distance S1 and away from a right side 40*b* toward a left side 40*c* of the paired front and rear side wall plate parts 13*a* and 13*b* by a distance S2. In the present embodiment, S1 is 50 millimeters, S2 is 35.1 millimeters, and R is 65 millimeters.

The disk roller 14 has a disk part 14*a* formed in a disk shape placed inside the guide passage 20 of the guide main body 13 and a shaft part 14*b* penetrating through the center of the disk part 14*a* in the front-rear direction and integrated with the disk part 14*a*, with both ends engaged and placed inside the front and rear restriction grooves 38 of the guide main body 13. The shaft part 14*b* is formed to have a diameter substantially equal to a dimension allowing movement in the restriction groove 38 in a state of being engaged inside the restriction grooves 38, that is, a dimension equal to the groove width of the restriction grooves 38. On the other hand, the disk part 14*a* is formed to have a diameter not abutting on the lower surface of the vertical plate part 213*c* of the upper wall part 13*c* when the shaft part 14*b* moves inside the restriction grooves 38.

Next, one example of a procedure of assembling the above-configured guide frame 11 is described. First, prior to assembling the guide main body 13, both front and rear ends of the shaft part 14*b* in the disk roller 14 are engaged into the restriction grooves 38 formed in the paired front and rear side wall plate parts 13*a* and 13*b*. Also, the convex parts 30 of the paired front and rear side wall plate parts 13*a* and 13*b* are made closely fit inside the notched parts 24 of the upper wall part 13*c* to bring about a state in which the paired front and rear side wall plate parts 13*a* and 13*b* are placed on both front and rear sides of the upper wall part 13*c*.

Next, the attachment screws 36 are screwed and fixed from a side wall plate part 13*a* side through the attachment holes 32 and the attachment hole 26 into the attachment holes 34. With this, the paired front and rear side wall plate parts 13*a* and 13*b* and the upper wall part 13*c* are integrally fixed, and the guide passage 20 extending to the left-right direction is formed inside the guide main body 13. Simultaneously, the disk roller 14 is also assembled to the inside of the guide main body 13. The disk roller 14 assembled to the inside of the guide main body 13 is placed so that the disk part 14*a* protrudes to the inside of the guide passage 20 and the shaft part 14*b* is movably retained inside the restriction grooves 38.

The feed plate 12 is formed to have a plate thickness slightly thinner than the width of the guide passage 20 of the guide main body 13 in the front-rear direction, and integrally has a control plate part 12*a* running inside the guide passage 20 in the left-right direction (the arrow c-d direction in FIG. 3) and an attachment part 12*b* provided one end side (lower end side) of the control plate part 12*a* and placed outside the guide passage 20. Also, the control plate part 12*a* is provided with a contact face 12*c* abutting, inside the guide passage 20, on the outer peripheral surface of the disk part 14*a* in the disk roller 14 so as to face the disk plate part 14*a*.

Figure 6:
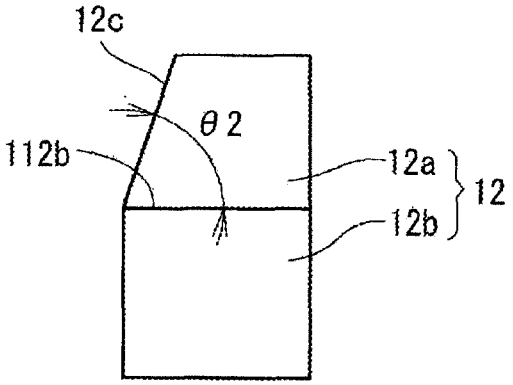
FIG. 6 is a diagram describing a detailed structure of a feed plate in the safety device for the sliding door depicted as the above first embodiment.

The contact face 12*c* of the feed plate 12 is formed, as depicted in FIG. 6, as a tilted surface rising from the fully-closed side toward the fully-open side so that an angle formed with an upper end face 112*b* of the attachment part 12*b* is θ2. Note that the angle θ2 in the embodiment is 71.5 degrees.

In the above-configured safety device 10, the guide frame 11 is attached to an appropriate place of the upper frame body forming an opening of a door, window, or the like and the feed plate 12 is attached to an appropriate place of the sliding door covering and uncovering the opening. In this case, the guide frame 11 and the feed plate 12 are placed in a positional relation so that when the guide frame 11 together with the sliding door is moved for opening or closing to an opening/closing direction (the arrow c-d direction in FIG. 3), the control plate part 12*a* of the feed plate 12 passes through the inside of the guide passage 20 of the guide frame 11.

FIG. 7 depicts diagrams of describing operation in the safety device 10 of the above first embodiment. Next, by using FIG. 7, the operation of the safety device 10 depicted in FIG. 1 to FIG. 6 is described. In the safety device 10 of this embodiment, when the sliding door is moved to the fully-open side, the feed plate 12 is also moved to the fully-open side together with the sliding door. Also, the disk roller 14 of the guide frame 11 rolls to an opening-direction end 38*a*1 side of the restriction groove 38 by the gradient (angle θ1) of the slow movement groove 38*a* rising from the fully-open side (arrow d side) toward the fully-closed side (arrow c side), and stops at the opening-direction end 38*a*1.

Figure 7A:
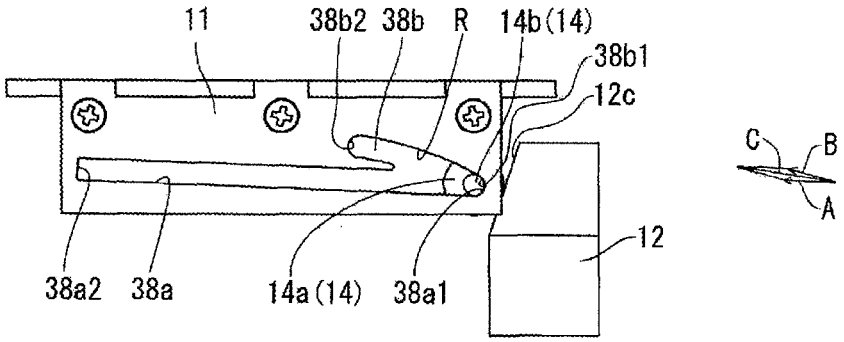

Then, when the sliding door is moved from the fully-open side to the fully-closed side, the feed plate 12 is also moved to the fully-closed side together with the sliding door. When the feed plate 12 is moved to a midway position on the fully-closed side, as depicted in FIG. 7A, the contact face

12*c* of the feed plate 12 abuts on the outer peripheral surface of the disk part 14*a* in the disk roller 14.

Figure 7B:
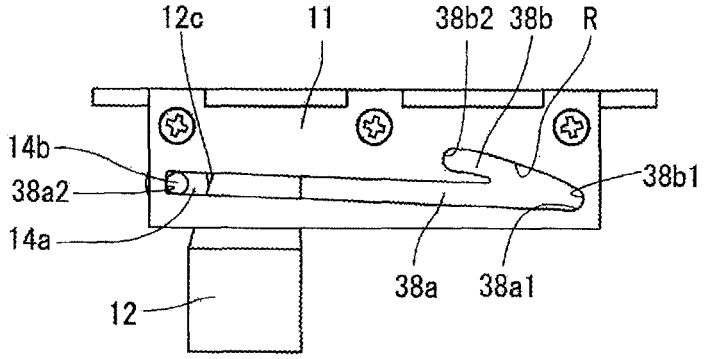

In this abutting at this time, if the contact face 12*c* of the feed plate 12 slowly and normally abuts on the disk part 14*a* of the disk roller 14 at a slow speed, the disk roller 14 is pushed slowly by the feed plate 12 to a closing direction (horizontal direction). Then, the disk roller 14 moves together with the feed plate 12 to the fully-closed side as the shaft part 14*b* is rolling inside the slow movement groove 38*a*. Also, as depicted in FIG. 7B, when the shaft part 14*b* of the disk roller 14 reaches a closing-direction end 38*a*2 of the slow movement groove 38*a*, the sliding door becomes in the fully-closed state, entirely covering the opening.

Figure 7C:
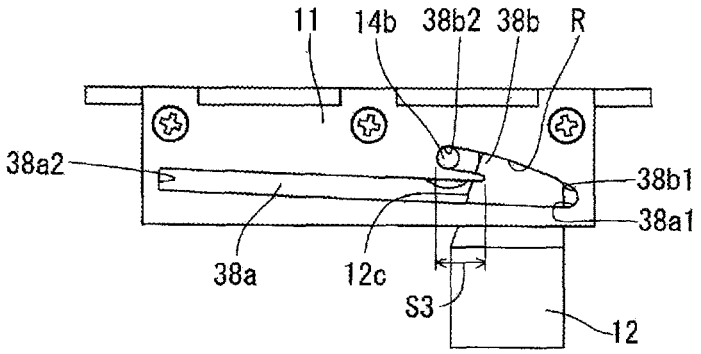

By contrast, when the sliding door is started to be closed vigorously, the contact face 12*c* of the feed plate 12 collides with the outer peripheral surface of the disk part 14*a* in the disk roller 14 vigorously with a predetermined strength or more. Then, the disk roller 14 is moved, by a force on a feed plate 12 side with a resultant vector of a closing direction of the sliding door (substantially horizontal direction: A direction) and a direction orthogonal to the tilted contact face 12*c* of the feed plate 12 (B direction) depicted in FIG. 7A, to a direction of that resultant vector (C direction) and, as depicted in FIG. 7C, the shaft part 14*b* is moved from the inside of the slow movement groove 38*a* along the curved surface R to the inside of the lock groove 38*b*. Also, the disk roller 14 is pushed by the feed plate 12, and is moved from a fully-open-side end 38*b*1 to the stopper part 38*b*2 of the lock groove 38*b*. When the shaft part 14*b* of the disk roller 14 is moved to the stopper part 38*b*2, abutting of the stopper part 38*b*2 and the shaft part 14*b* causes the movement of the disk roller 14 to stop, and the feed plate 12 also stops at that position together with the sliding door. That is, the sliding door is once inhibited from becoming in the fully-closed state, and this stop prevents a finger or the like from being caught between the sliding door and a pillar or bar and also prevents the sliding door from colliding with the pillar at the opening to cause a large noise.

Also, to cause the sliding door to be released from the once stopped state to make a transition to the fully-closed state again, the feed plate 12 is returned together with the sliding door to the fully-open side by a distance S3 depicted in FIG. 7C. Then, the disk roller 14 is returned to the fully-open side by the distance S3 owing to the tilted shape of the lock groove 38*b*, and soon drops from the inside of the lock groove 38*b* to the inside of the slow movement groove 38*a* to be returned to the inside of the slow movement groove 38*a*. Then, the sliding door is moved to the fully-closed side again, the disk roller 14 is again pushed by the feed plate 12 to a closing direction (horizontal direction), and moves together with the feed plate 12 to the fully-closed side as the shaft part 14*b* is rolling inside the slow movement groove 38*a*. Then, as depicted in FIG. 7B, the shaft part 14*b* of the disk roller 14 soon reaches the closing-direction end 38*a*2 of the slow movement groove 38*a* and, upon reaching, the sliding door becomes in the fully-closed state, entirely covering the opening.

Also, when the sliding door is opened again, the sliding door is moved to the fully-open side. Then, as following the movement of the feed plate 12 to the fully-open side, the disk roller 14 also rolls by the gradient of the slow movement groove 38*a* to be returned to the opening-direction end 38*a*1 of the slow movement groove 38*a*. Thereafter, the device waits until the sliding door is closed again. Then, when it is closed, the same motion is repeated.

Therefore, according to this safety device 10 of the first embodiment, when the sliding door is normally slowly closed, it can be just closed to the fully-closed position. On the other hand, when the sliding door is vigorously closed, the shaft part 14*b* is automatically moved from the inside of the slow movement groove 38*a* to the inside of the lock groove 38*b* by the gradient of the contact face 12*c* of the feed plate 12, and the disk roller 14 is soon nipped between the stopper part 38*b*2 of the lock groove 38*b* and the contact face 12*c* of the feed plate 12, thereby causing a locked state. Then, the feed plate 12 is inhibited from moving together with the sliding door further to the closing side, and thus it is possible to prevent a finger or the like from being inadvertently caught in opening/closing operation of the sliding door and prevent the occurrence of a large noise.

Also, after locking once, the locking is automatically released when the sliding door is returned by the distance S3 and operation can be performed again to the fully-closed state, thereby achieving simplification of operation.

Furthermore, the shape of the lock groove 38*b* is formed as the curved surface R with a curvature equal to that of a circle rendered with the radius R1. Thus, when the disk roller 14 escapes to a lock groove 38*b* side, the shaft part 14*b* moves to the inside of the lock groove 38*b* along that curved surface R. This allows smooth movement.

Still further, by changing the shape of the curved surface R of the lock groove 38*b* and the shape of the gradient of the contact face 12*c* of the feed plate 12, that is, the angle θ2, the operation area for lock operation and others can be easily changed.

Note that the direction of each of the vectors described above can be freely changed by adjusting the tilt angle of the guide frame 11 or the feed plate 12. And, by changing the direction of each vector, it is also possible to variably adjust the operation speed of the sliding door which is started to be locked.

Still further, the tilt angle of the guide frame 11 or the feed plate 12 can be easily adjusted by an adjustment mechanism using a screw or the like.

Yet still further, impulsive sound and so forth occurring when the disk roller 14 and the feed plate vigorously collide with each other can be absorbed by providing a shock absorbing mechanism (such as rubber or a shock absorber) between the guide frame 11 or the feed plate 12 and a window frame or a window. With absorption, silencing can also be achieved.

Figure 8:
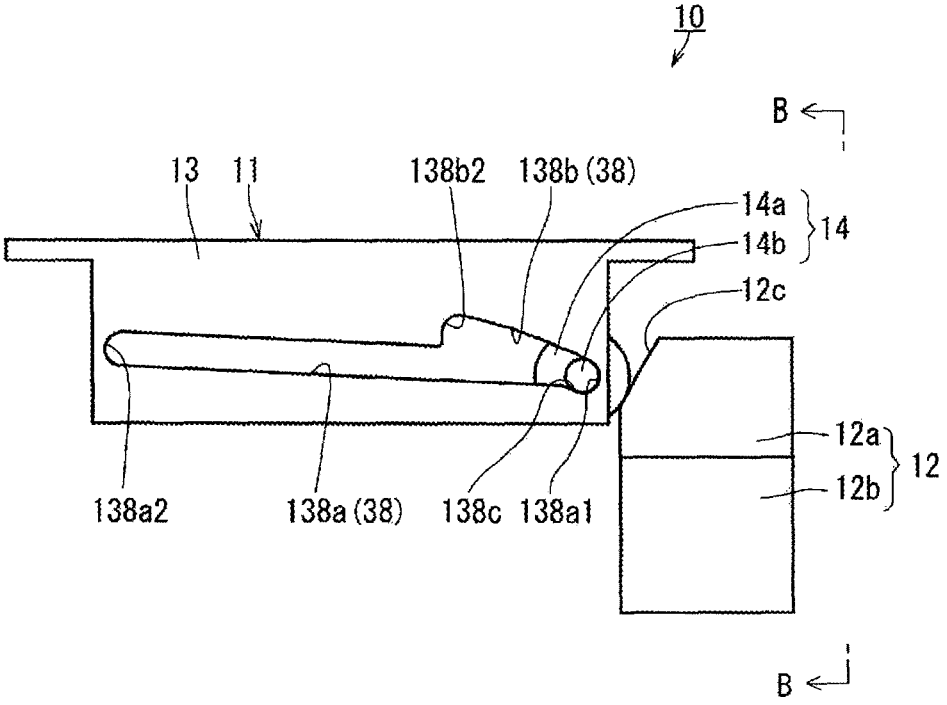
FIG. 8 is a side view of a safety device for a sliding door depicted as a second embodiment of the present invention viewed from a front side.
Figure 9:
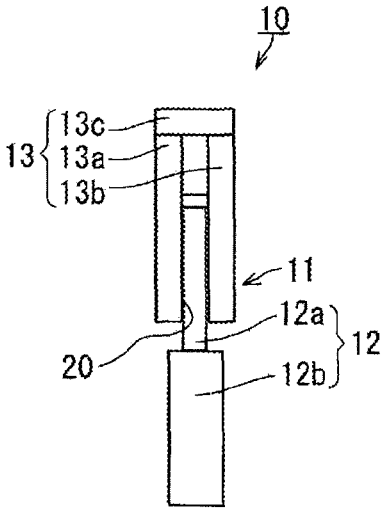
FIG. 9 is a side view of the safety device for the sliding door depicted as the above second embodiment viewed from a direction of a B-B line in FIG. 8.

FIG. 8 and FIG. 9 depict a second embodiment of the safety device 10 according to the present invention. FIG. 8 is a side view of the safety device 10 viewed from the front, and FIG. 9 is a side view of the safety device 10 viewed from a direction of a B-B line of FIG. 8. In the configuration of this second embodiment, the structure of the restriction groove 38 of the guide frame 11 and the shape of the gradient (angle θ2) of the contact face 12*c* in the feed plate 12 are changed and the other structures are identical to those in FIG. 1 to FIG. 7, and thus identical components are provided with the same reference numeral and redundant description is omitted.

In FIG. 8 and FIG. 9, as with the first embodiment, the restriction grooves 38 provided to the paired front and rear side wall plate parts 13*a* and 13*b*, respectively, are formed to have substantially symmetrical shapes and be in a state of being hollowed in the front-rear direction.

The restriction grooves 38 are each configured of: a slow movement groove 138*a* provided to extend along a direction of movement of the sliding door, that is, the left-right direction (the arrow c-d direction); and a lock groove 138*b* consecutively connected to the slow movement groove 138*a* and formed in a state of being spread so as to rise from the root of that slow movement groove 138*a*, that is, a closing-direction end 138*a*1, toward a closing side of the sliding door.

Figure 10:
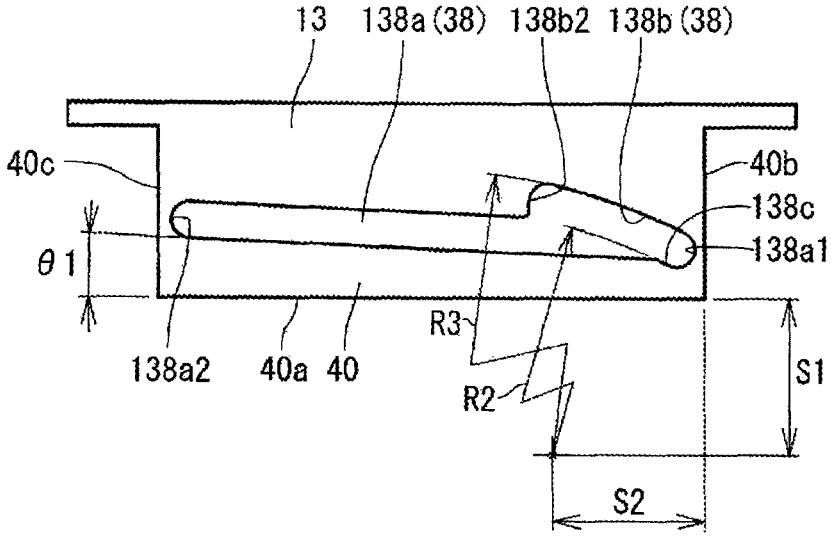
FIG. 10 is a diagram describing a detailed structure of a guide frame in the safety device for the sliding door depicted as the above second embodiment.

The slow movement groove 138*a* is formed, as depicted in FIG. 10, so as to be tilted with respect to the lower side 40 of the paired front and rear side wall plate parts 13*a* and 13*b* from a fully-open side (the arrow d side) toward the fully-closed side (the arrow c side) and have an angle θ1. Note that the angle θ1 in the present embodiment is substantially 2.5 degrees. Also, the slow movement groove 138*a* is provided with an opening-direction end groove 138*c* at an opening-direction end, the groove tilted, with a curved surface, from a termination end of the slow movement groove 138*a* further downward. Note that the curved surface of the opening-direction end groove 138*c* is formed as a curved surface having a curvature substantially equal to that of a circle rendered as having a radius R2 by taking, as a center O2, a point away downward from the lower side 40*a* of the paired front and rear side wall plate parts 13*a* and 13*b* by the distance S1 and away from the right side 40*b* toward the left side 40*c* of the paired front and rear side wall plate parts 13*a* and 13*b* by the distance S2. In the present embodiment, S1 is 50.7 millimeters, S2 is 31.4 millimeters, and R2 is 61 millimeters.

Similarly as depicted in FIG. 10, the lock groove 138*b* is formed as a curved surface arcing continuously from the opening-direction end groove 138*c*. Note that the curved surface is formed as a curved surface having a curvature substantially equal to that of a circle rendered as having a radius R3 by taking O2 as a center. In the present embodiment, the radius R3 is 65 millimeters.

The feed plate 12 includes the control plate part 12*a* and the attachment part 12*b*, and the control plate part 12*a* is provided with the contact face 12*c* abutting, inside the guide passage 20, on the outer peripheral surface of the disk part 14*a* in the disk roller 14 so as to face the disk plate part 14*a*.

Figure 11:
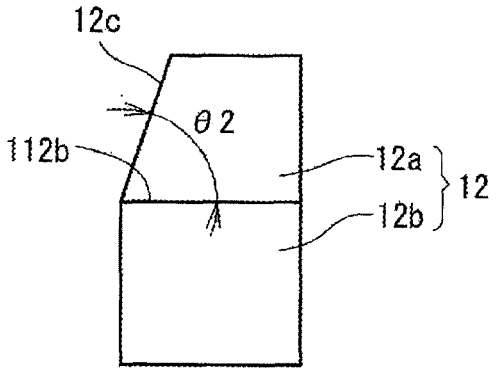
FIG. 11 is a diagram describing a detailed structure of a feed plate in the safety device for the sliding door depicted as the above second embodiment.

The contact face 12*c* of the feed plate 12 is formed, as depicted in FIG. 11, as a tilted surface rising from the fully-closed side toward the fully-open side so as to have the angle θ2 formed with the upper end face 112*b* of the attachment part 12*b*. Note that the angle θ2 in the embodiment is 60 degrees.

FIG. 12 depicts diagrams of describing operation in the safety device 10 of the above second embodiment. Next, by using FIG. 12, the operation of the safety device 10 depicted in FIG. 8 and FIG. 9 is described. Also in the safety device 10 of this second embodiment 2, when the sliding door is moved to the fully-open side, the feed plate 12 is also moved to the fully-open side together with the sliding door. Also, the disk roller 14 of the guide frame 11 rolls to an opening-direction end groove 138*c* side of the restriction groove 38 by the gradient (angle θ1) of the slow movement groove 38*a* rising from the fully-open side (arrow d side depicted in FIG. 3) toward the fully-closed side (arrow c side depicted in FIG. 3), and stops inside the opening-direction end groove 138*c*.

Figure 12A:
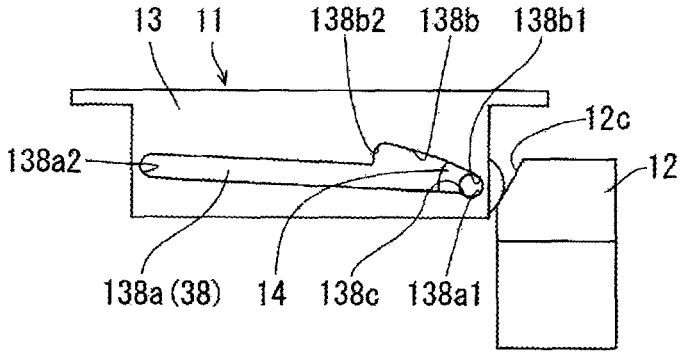

Then, when the sliding door is moved from the fully-open side to the fully-closed side, the feed plate 12 is also moved to the fully-closed side together with the sliding door. When the feed plate 12 is moved to a midway position on the fully-closed side, as depicted in FIG. 12A, the contact face 12*c* of the feed plate 12 abuts on the outer peripheral surface of the disk part 14*a* in the disk roller 14.

Figure 12B:
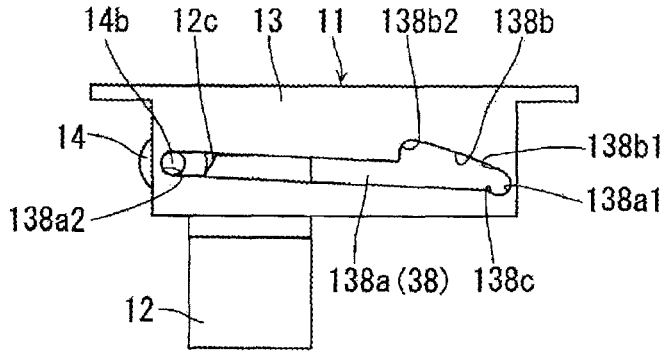

In this abutting at this time, if the contact face 12*c* of the feed plate 12 slowly and normally abuts on the disk part 14*a* of the disk roller 14 at a slow speed, the disk roller 14 is pushed slowly by the feed plate 12 to a closing direction (horizontal direction). Then, the shaft part 14*b* rolls and enters the inside of the slow movement groove 138*a* from the inside of the opening-direction end groove 138*c* and moves inside the slow movement groove 138*a* to the fully-closed side together with the feed plate 12. Also, as depicted in FIG. 12B, when the shaft part 14*b* of the disk roller 14 reaches a closing-direction end 138*a*2 of the slow movement groove 138*a*, the sliding door becomes in the fully-closed state, entirely covering the opening.

Figure 12C:
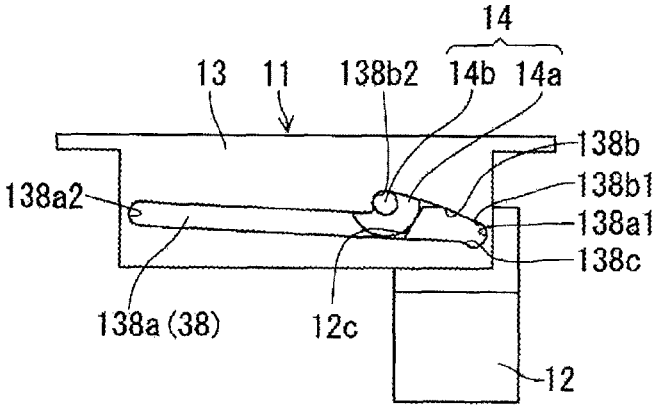

By contrast, when the sliding door is started to be closed vigorously, the contact face 12*c* of the feed plate 12 collides with the outer peripheral surface of the disk part 14*a* in the disk roller 14 vigorously with a predetermined strength or more. Then, as with the vectors depicted in FIG. 7A, the disk roller 14 is moved, by a force on a feed plate 12 side with a resultant vector of a closing direction of the sliding door (substantially horizontal direction: A direction) and a direction orthogonal to the tilted contact face 12*c* of the feed plate 12 (B direction), to a direction of that resultant vector (C direction) and, as depicted in FIG. 12C, the shaft part 14*b* is moved from the inside of the opening-direction end groove 138*c* along the curved surface to the inside of the lock groove 138*b*. Also, the disk roller 14 is pushed by the feed plate 12, and is moved from a fully-open-side end 138*b*1 to a stopper part 138*b*2 of the lock groove 138*b*. When the shaft part 14*b* of the disk roller 14 is moved to the stopper part 138*b*2, abutting of the stopper part 138*b*2 and the shaft part 14*b* causes the movement of the disk roller 14 to stop, and the feed plate 12 also stops at that position together with the sliding door. That is, the sliding door is once inhibited from becoming in the fully-closed state, and this stop prevents a finger or the like from being caught between the sliding door and a pillar or bar and also prevents the sliding door from colliding with the pillar at the opening to cause a large noise.

Also, to cause the sliding door to be released from the once stopped state to make a transition to the fully-closed state again, the feed plate 12 is slightly returned to the fully-open side together with the sliding door. Then, the disk roller 14 loses a nipping force by the stopper part 138*b* and the feed plate 12, dropping from the inside of the lock groove 138*b* to the inside of the slow movement groove 138*a* to be returned to the inside of the slow movement groove 138*a*. Then, when the sliding door is moved to the fully-closed side again, the disk roller 14 is again pushed by the feed plate 12 to a closing direction (horizontal direction), and moves together with the feed plate 12 to the fully-closed side as the shaft part 14*b* is rolling inside the slow movement groove 138*a*. Then, as depicted in FIG. 12B, the shaft part 14*b* of the disk roller 14 soon reaches the closing-direction end 138*a*2 of the slow movement groove 138*a* and, upon reaching, the sliding door becomes in the fully-closed state, entirely covering the opening.

Also, when the sliding door is opened again, the sliding door is moved to the fully-open side. Then, as following the movement of the feed plate 12 to the fully-open side, the disk roller 14 also rolls by the gradient of the slow movement groove 138*a* to be returned to the opening-direction end groove 138*c*. Thereafter, the device waits until the sliding door is closed again. Then, when it is closed, the same motion is repeated.

Therefore, also in the safety device 10 of this second embodiment, when the sliding door is normally slowly closed, it can be just closed to the fully-closed position. On the other hand, when the sliding door is vigorously closed, the shaft part 14*b* is automatically moved from the inside of the opening-direction end groove 138*c* to the inside of the lock groove 138*b* by the gradient of the contact face 12*c* of the feed plate 12, and the disk roller 14 is soon nipped between the stopper part 138*b*2 of the lock groove 138*b* and the contact face 12*c* of the feed plate 12, thereby causing a locked state. Then, the feed plate 12 is inhibited from moving together with the sliding door further to the closing side, and thus it is possible to prevent a finger or the like from being inadvertently caught in opening/closing operation of the sliding door and prevent the occurrence of a large noise.

Also, after locking once, the locking is automatically released when the sliding door is slightly returned and operation can be performed again to the fully-closed state, thereby achieving simplification of operation.

Furthermore, the shape of the lock groove 138*b* is formed as the curved surface with a curvature equal to that of a circle rendered with the radius R3. Thus, when the disk roller 14 escapes to a lock groove 138*b* side, the shaft part 14*b* moves to the inside of the lock groove 138*b* along that curved surface. This allows smooth movement.

Still further, by changing the shape of the curved surface of the lock groove 138*b* and the shape of the gradient of the contact face 12*c* of the feed plate 12, that is, the angle θ2, the operation area for lock operation and others can be easily changed.

Figure 13:
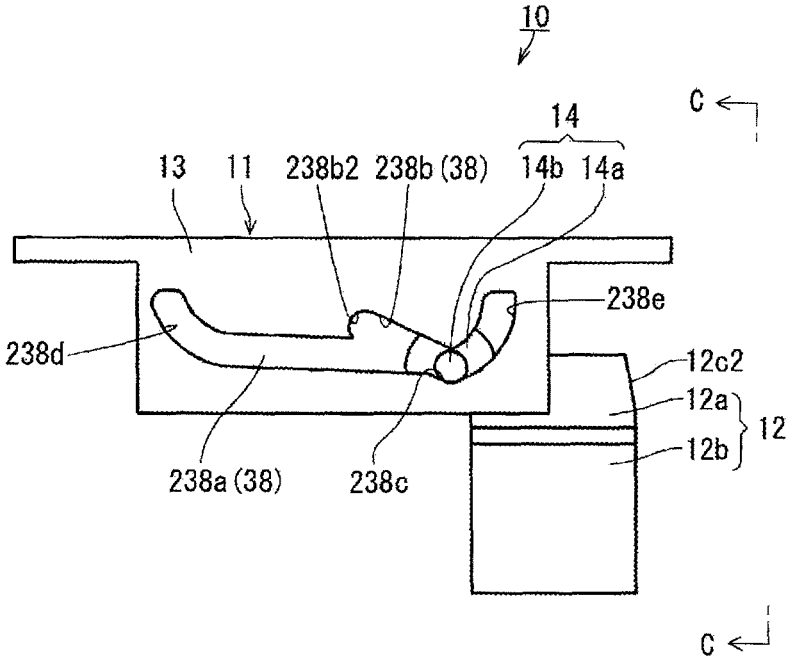
FIG. 13 is a side view of a safety device for a sliding door depicted as a third embodiment of the present invention viewed from a front side.
Figure 14:
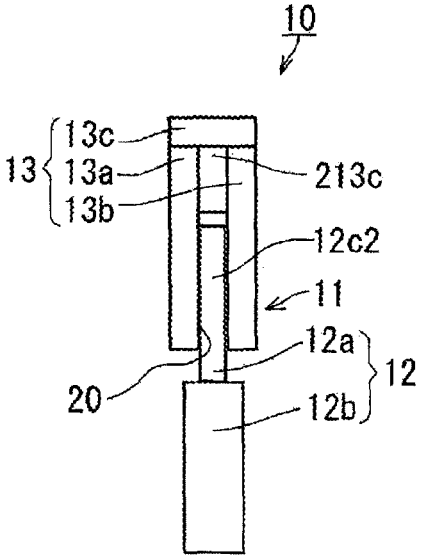
FIG. 14 is a side view of the safety device for the sliding door depicted as the third embodiment of the present invention viewed from a direction of a C-C line in FIG. 13.

FIG. 13 and FIG. 14 depict a third embodiment of the safety device 10 according to the present invention. FIG. 13 is a side view of the safety device 10 viewed from the front, and FIG. 14 is a side view of the safety device 10 viewed from a direction of a C-C line of FIG. 13. In the configuration of this third embodiment, the structure of the restriction groove 38 of a guide frame 11 and the structure and the shape of the gradient (angle θ2 and angle θ4) of contact faces 12*c*1 and 12*c*2 in the feed plate 12 are changed and the other structures are identical to those in FIG. 1 to FIG. 7, and thus identical components are provided with the same reference numeral and redundant description is omitted.

In FIG. 13 and FIG. 14, as with the first embodiment and the second embodiment, the restriction grooves 38 provided to the paired front and rear side wall plate parts 13*a* and 13*b*, respectively, are formed to have substantially symmetrical shapes and be in a state of being hollowed in the front-rear direction.

The restriction grooves 38 are each configured of: a slow movement groove 238*a* provided to extend along a direction of movement of the sliding door, that is, the left-right direction (the arrow c-d direction); a lock groove 238*b* consecutively connected to the slow movement groove 238*a*; a neutral position groove 238*c*; a closing-direction end groove 238*d*; and an opening-direction end groove 238*e*.

Figure 15:
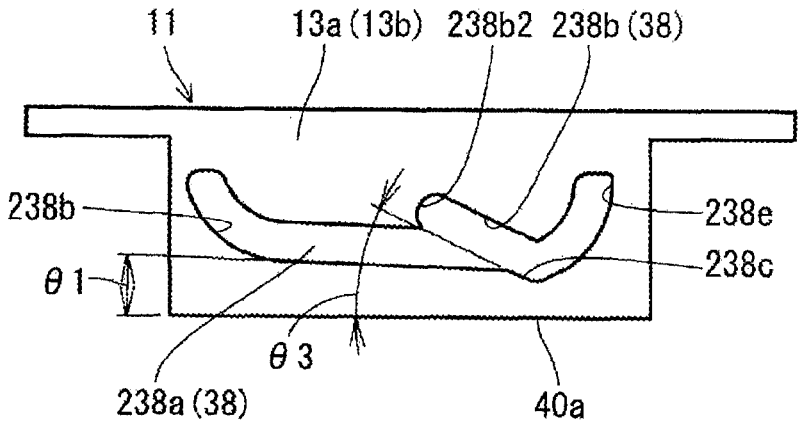
FIG. 15 is a diagram describing a detailed structure of a guide frame in the safety device for the sliding door depicted as the above third embodiment.
Figure 16:
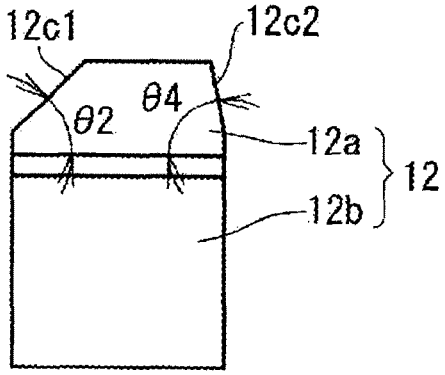
FIG. 16 is a diagram describing a detailed structure of a feed plate in the safety device for the sliding door depicted as the above third embodiment.

The slow movement groove 238*a* is formed, as depicted in FIG. 15, so as to be tilted with respect to the lower side 40*a* of the paired front and rear side wall plate parts 13*a* and 13*b* from a fully-open side (the arrow d side depicted in FIG. 3) toward the fully-closed side (the arrow c side depicted in FIG. 3) and have the angle θ1. Note that the angle θ1 in the present embodiment is substantially two degrees. Also, the slow movement groove 238*a* has formed and connected at a closing-direction end the closing-direction end groove 238*d* tilted, with a recessed curved surface, from a termination end of the slow movement groove 238*a* further upward, and has formed and connected at the closing-direction end the neutral position groove 238*c* tilted, with a protruded curved surface, from the termination end of the slow movement groove 238*a* further downward and the opening-direction end groove 238*e* tilted, with a recessed curved surface, upward from the neutral position groove 238*c*. Note that the closing-direction end groove 238*d* and the opening-direction end groove 238*e* are to let the disk roller 14 escape upward (upper wall part 13*c* side) so that the feed plate 12 can go and pass through a lower side of the disk roller 14. Therefore, although not depicted, notched parts 28 (refer to FIG. 4) for letting the disk roller 14 escape are formed on a lower end side of the vertical plate part 213*c* of the upper wall part 13*c* so as to correspond to the lock groove 38*b*, the closing-direction end groove 238*d*, and the opening-direction end groove 238*e*.

Similarly as depicted in FIG. 15, the lock groove 238*b* is formed continuously from the neutral position groove 238*c* as tilted with an angle θ3 with respect to the lower side 40*a* of the paired front and rear side wall plate parts 13*a* and 13*b* so as to rise from the fully-open side (arrow d side) toward the fully-closed side (arrow c side). Note that the angle θ3 of the lock groove 238*b* is approximately 25.15 degrees in the present embodiment.

The feed plate 12 includes, as with the first embodiment and the second embodiment, the control plate part 12*a* and the attachment part 12*b*. The feed plate 12 is provided with the contact faces 12*c*1 and 12*c*2 on both left and right sides of the control plate part 12*a*, respectively, the contact faces abutting on the outer peripheral surface of the disk part 14*a* in the disk roller 14 in the respective guide passages 20 so as to be opposed to the disk part 14*a*. Note that the gradient (angle θ2) of the contact face 12*c*1 is 45 degrees and the gradient (angle θ4) of the contact face 12*c*2 is 80 degrees in the present embodiment.

FIG. 17 and FIG. 18 depict diagrams of describing operation in the safety device 10 of the above third embodiment. Next, by using FIG. 17 and FIG. 18, the operation of the safety device 10 depicted in FIG. 13 and FIG. 14 is described. Also in the safety device 10 of this third embodiment, when the sliding door is moved to the fully-open side, the feed plate 12 is also moved to the fully-open side together with the sliding door. Also, the disk roller 14 of the guide frame 11 rolls to an opening-direction end groove 238*e* side of the restriction groove 38 by the gradient (angle θ1) of the slow movement groove 238*a* rising from the fully-open side (arrow d side depicted in FIG. 3) toward the fully-closed side (arrow c side depicted in FIG. 3), and stops inside the neutral position groove 238*c*.

Figure 17A:
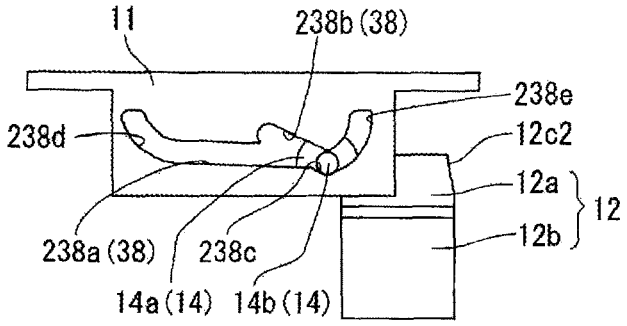

Then, when the sliding door is moved from the fully-open side to the fully-closed side, the feed plate 12 is also moved to the fully-closed side together with the sliding door. When the feed plate 12 is moved to a midway position on the fully-closed side, as depicted in FIG. 17A, the contact face 12*c*1 of the feed plate 12 abuts on the outer peripheral surface of the disk part 14*a* in the disk roller 14.

Figure 17B:
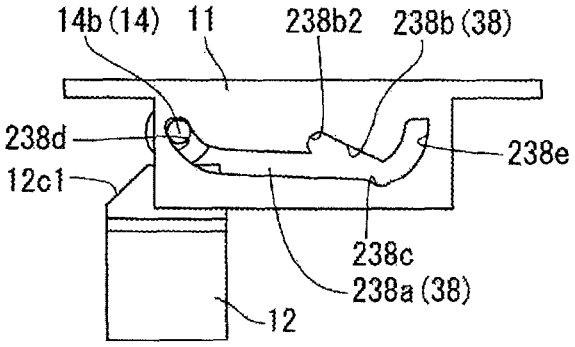
Figure 17C:
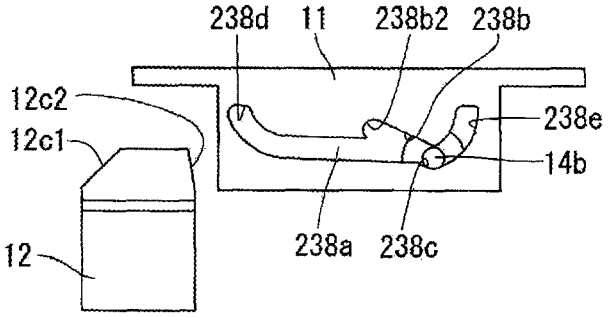

In this abutting at this time, if the contact face 12*c*1 of the feed plate 12 slowly and normally abuts on the disk part 14*a* of the disk roller 14 at a slow speed, the disk roller 14 is pushed slowly by the feed plate 12 to a closing direction (horizontal direction). Then, the shaft part 14*b* rolls and enters the inside of the slow movement groove 238*a* from the inside of the neutral position groove 238*c* and moves inside the slow movement groove 238*a* to the fully-closed side together with the feed plate 12. Also, upon reaching a closing-direction end of the slow movement groove 238*a*, as depicted in FIG. 17B, the shaft part 14*b* of the disk roller 14 rises inside the closing-direction end groove 238*d* to escape from an upper end of the feed plate 12. This allows the feed plate 12 to move further in a fully-closing direction together with the sliding door as depicted in FIG. 17C. Then, the disk roller 14 rolls by the gradient (angle θ1) of the slow movement groove 238*a* to an opening-direction end groove 238*e* of the restriction groove 38 and is returned to stop inside of the neutral position groove 238*c*.

Figure 17D:
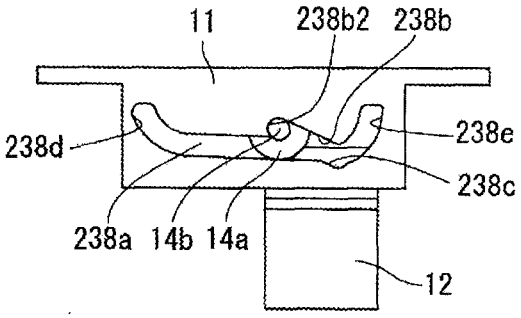

By contrast, when the sliding door is started to be closed vigorously, the contact face 12*c*1 of the feed plate 12 collides with the outer peripheral surface of the disk part 14*a* in the disk roller 14 vigorously with a predetermined strength or more. Then, as with the vectors depicted in FIG. 7A, the disk roller 14 is moved, by a force on a feed plate 12 side with a resultant vector of a closing direction of the sliding door (substantially horizontal direction: A direction) and a direction orthogonal to the tilted contact face 12*c*1 of the feed plate 12 (B direction), to a direction of that resultant vector (C direction) and, as depicted in FIG. 17D, the shaft part 14*b* is moved from the inside of the neutral position groove 238*c* to the inside of the lock groove 238*b*. Also, the disk roller 14 is pushed by the feed plate 12, and is moved to a stopper part 238*b*2 of the lock groove 238*b*. When the shaft part 14*b* of the disk roller 14 is moved to the stopper part 238*b*2, abutting of the stopper part 238*b*2 and the shaft part 14*b* causes the movement of the disk roller 14 to stop, and the feed plate 12 also stops at that position together with the sliding door. That is, the sliding door is once inhibited from becoming in the fully-closed state, and this stop prevents a finger or the like from being caught between the sliding door and a pillar or bar and also prevents the sliding door from colliding with the pillar at the opening to cause a large noise.

Also, to cause the sliding door to be released from the once stopped state to make a transition to the fully-closed state again, the feed plate 12 is slightly returned to the fully-open side together with the sliding door. Then, the disk roller 14 loses a nipping force by the stopper part 238*b*2 and the feed plate 12, dropping from the inside of the lock groove 238*b* to the inside of the slow movement groove 238*a* to be returned to the inside of the slow movement groove 238*a*. Then, when the sliding door is moved to the fully-closed side again, the disk roller 14 is again pushed by the feed plate 12 to a closing direction (horizontal direction), and moves together with the feed plate 12 to the fully-closed side as the shaft part 14*b* is rolling inside the slow movement groove 238*a*. Then, as depicted in FIG. 17B, the shaft part 14*b* of the disk roller 14 soon reaches the closing-direction end of the slow movement groove 238*a*. Then, following the operation of FIG. 17B, the feed plate 12 and the sliding door are allowed to move to the fully-closed side.

Figure 18A:
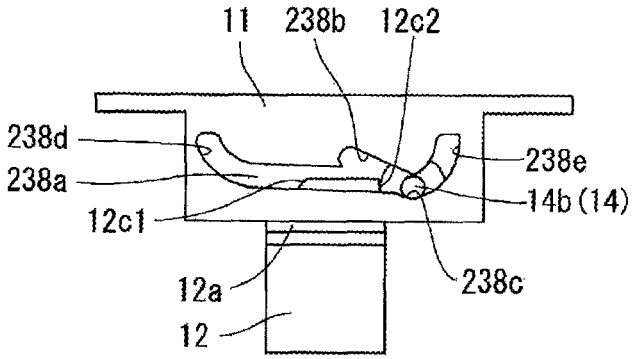
Figure 18B:
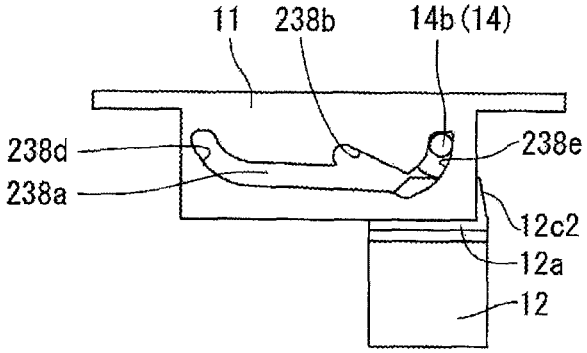
Figure 18C:
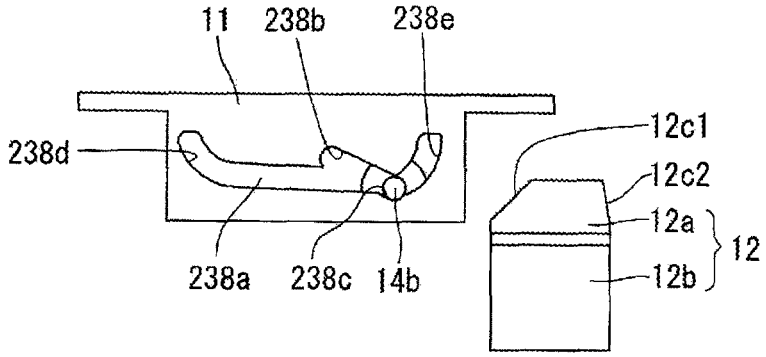

Also, when the sliding door is opened again, the sliding door is moved to the fully-open side. Then, the feed plate 12 also moves to the fully-open side together with the sliding door. When the feed plate 12 is moved to a midway position on the fully-open side, as depicted in FIG. 18A, the contact face 12*c*2 of the feed plate 12 abuts on the outer peripheral surface of the disk part 14*a* in the disk roller 14. Also, the shaft part 14*b* of the disk roller 14 reaches the closing-direction end of the slow movement groove 238*a*. Then, the disk roller 14 is moved, by a force on a feed plate 12 side with a resultant vector of an opening direction of the sliding door (substantially horizontal direction) and a direction orthogonal to the tilted contact face 12*c*2 of the feed plate 12, to a direction of that resultant vector and, as depicted in FIG. 18B, rises inside the opening-direction end groove 238*e* to escape from the feed plate 12. As depicted in FIG. 18C, this allows the feed plate 12 to move further to a fully-open direction together with the sliding door. Then, the disk roller 14 rolls by the gradient of the opening-direction end groove 238*e* to a closing-direction end side and is returned to stop inside the neutral position groove 238*c*.

Therefore, in the safety device 10 of this third embodiment, the feed plate 12 can go over the position of the guide frame 11 to move to each of the fully-closed side and the fully-open side. This allows the safety device 10 to be set at a free position where the sliding door passes.

Also in the safety device 10 of the third embodiment, when the sliding door is normally slowly closed, it can be closed to the fully-closed position. On the other hand, when the sliding door is vigorously closed, the shaft part 14*b* is automatically moved from the neutral position groove 238*c* to the inside of the lock groove 238*b* by the gradient of the contact face 12*c*1 of the feed plate 12, and the disk roller 14 is soon nipped between the stopper part 238*b*2 of the lock groove 238*b* and the contact face 12*c*1 of the feed plate 12, thereby causing a locked state. Then, the feed plate 12 is inhibited from moving together with the sliding door further to the closing side, and thus it is possible to prevent a finger or the like from being inadvertently caught in opening/closing operation of the sliding door and prevent the occurrence of a large noise.

Also, after locking once, the locking is automatically released when the sliding door is slightly returned and operation can be performed again to the fully-closed state, thereby achieving simplification of operation.

Furthermore, the shape of the lock groove 238*b* is formed as the tilted surface. Thus, when the disk roller 14 escapes to a lock groove 238*b* side, the shaft part 14*b* moves to the inside of the lock groove 238*b* along that tilted surface. This allows smooth movement.

Still further, by changing the shape of the tilted surface of the lock groove 238*b* and the shape of the gradient of the contact face 12*c*1 of the feed plate 12, that is, the shapes of the angle θ3 and the angle θ2, the operation area for lock operation and others can be easily changed.

Note that while the case of a sliding door has been described in each of the above embodiments, this sliding door includes all of a shoji paper sliding door, a fusuma paper sliding door, a window, and others of these types.

Also, the lock grooves 38*b*, 138*b*, and 238*b* and the disk roller 14 are locked when the sliding door is fiercely moved to the fully-closed side, the safety device 10 can be attached with its orientation reversed and the sliding door can be locked when it is fiercely moved to a fully-open side.

Figure 19:
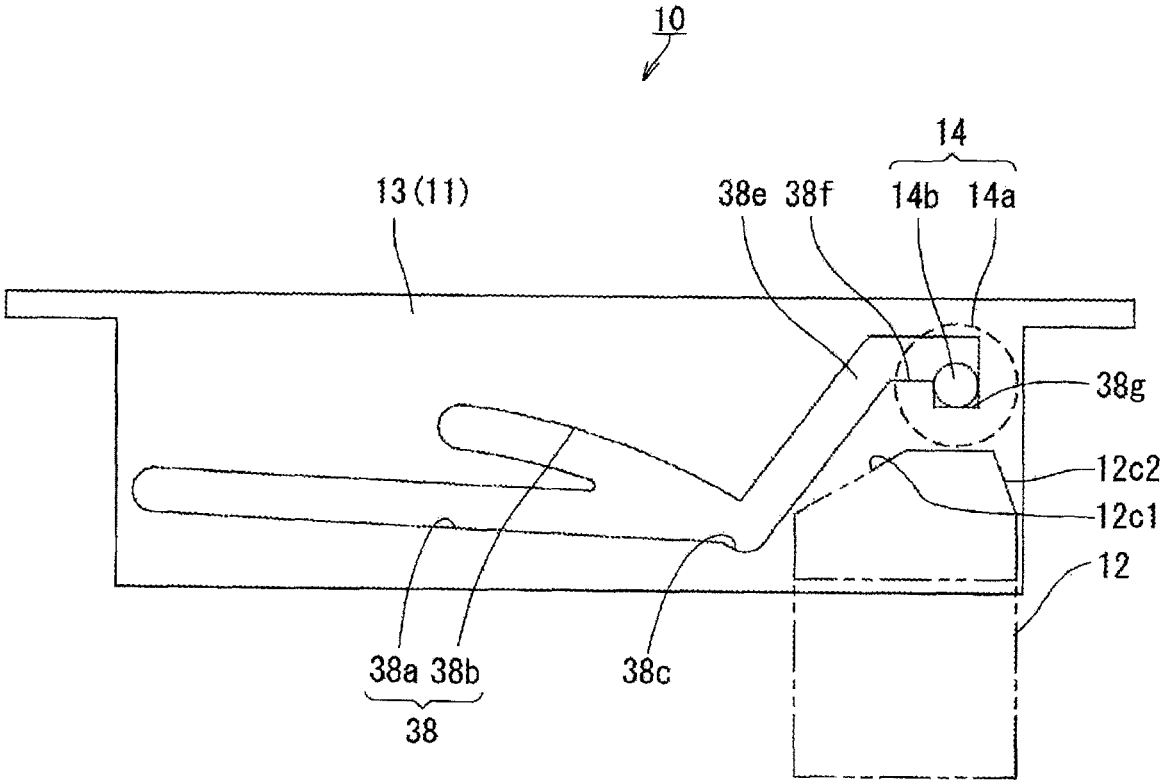
FIG. 19 is a side view of the safety device viewed from a front side, describing one example of a mechanism for switching the safety device for the sliding door of the present invention to valid and invalid.

Also, while it is disclosed in each of the above-described embodiments, that the safety device 10 is configured to always monitor operation of whether the sliding door is vigorously opened or closed when opened or closed, when monitoring by the safety device 10 is not required, the monitoring by the safety device 10 can be released and can be performed again when required. Its monitoring switching mechanism can be configured by, for example, as depicted in FIG. 19, providing, to each restriction groove 38; the slow movement groove 38*a* provided to extend along a direction of movement of the sliding door, that is, the left-right direction (the arrow c-d direction); the lock groove 38*b* consecutively connected to the slow movement groove 38*a*; a neutral position groove 38*c*; an opening-direction end groove 38*e*; a disk roller retreat groove 38*f*; and a locking groove 38*g*, and providing the contact faces 12*c*1 and 12*c*2 abutting on the outer periphery surface of the disk part 14*a* in the disk roller 14 inside the guide passage 20 so that the contact faces are opposed to the disk part 14*a*.

As for the disk roller retreat groove 38*f* and the locking groove 38*g*, when the disk roller 14 is placed in this disk roller retreat groove 38*f* or the locking groove 38*g*, that placed disk roller 14 is placed in a state of being retreated to a position higher than the upper surface of the feed plate 12 passing through the inside of the guide passage 20. And, even if the feed plate 12 passes through the inside of the guide passage 20, the feed plate 12 does not abut on the disk roller 14. Therefore, if monitoring by the safety device 10 is not required, with the disk roller 14 placed inside the disk roller retreat groove 38*f*, the monitoring by the safety device 10 can be made invalid. Furthermore, when the disk roller is moved from the disk roller retreat groove 38*f* to the inside of the locking groove 38*g*, the locking groove 38*g* is recessed below the disk roller retreat groove 38*f* and the shaft part 14*b* of the disk roller 14 is dropped into the inside of this recessed disk roller retreat groove 38*f* to be locked at that position. This allows the state in which the monitoring by the safety device 10 is made invalid to be reliably locked.

On the other hand, when the safety device 10 is required, the shaft part 14*b* of the disk roller 14 is moved from the inside of the locking groove 38*g* to the disk roller retreat groove 38*f*, and is further returned from the inside of the disk roller retreat groove 38*f* through the opening-direction end groove 38*e* to the inside of the neutral position groove 38*c*, thereby allowing the safety device 10 to be returned again to a valid state for use.

Furthermore, other than the above, the present invention can be variously modified as long as such modifications do not deviate the spirit of the present invention and, it goes without saying that the present invention covers the modified ones.

REFERENCE SIGNS LIST

10 safety device for a sliding door
11 guide frame
12 feed plate
12*a* control plate part
12*b* attachment part
12*c* contact face
12*c*1, 12*c*2 contact face
13 guide main body
13*a*, 13*b* side wall plate part
13*c* upper wall part
113*c* horizontal attachment plate part
213*c* vertical plate part
313*c* attachment seat part
14 disk roller
14*a* disk part
14*b* shaft part
20 guide passage
22 attachment hole
24 notched part
26 attachment hole
28 notched part
30 convex part
32 attachment hole
34 attachment hole
36 attachment screw
38 restriction groove
38*a* slow movement groove
38*a*1 opening-direction end
38*a*2 closing-direction end
38*b* lock groove
38*b*1 fully-open-side end
38*b*2 stopper part
38*c* neutral position groove
38*d* closing-direction end groove
38*e* opening-direction end groove
38*f* disk roller retreat groove
38*g* locking groove
40*a* lower side
138*a* slow movement groove
138*a*1 opening-direction end
138*c* neutral position groove
138*a*2 closing-direction end
138*b* lock groove
138*b*1 fully-open-side end
138*b*2 stopper part
238*a* slow movement groove
238*b* lock groove
238*b*2 stopper part
238*c* neutral position groove
238*d* closing-direction end groove
238*e* opening-direction end groove
S1 distance
S2 distance
S3 distance where a feed plate is returned
O1, O2 center
R curved surfaces
R1, R2, R3 radius of the curved surface
L1 width of the notched part in a left-right direction
t plate thickness of the side wall plate part
θ1 gradient of the slow movement groove
θ2, θ4 gradient of a contact face
θ3 gradient of the lock groove

What is claimed is:

1. A safety device for a sliding door capable of making to-and-fro movements for covering and uncovering an opening, the device comprising a guide frame and a feed plate to be separately attached to a side of the opening and a side of the sliding door so as to be opposed to each other, wherein the guide frame includes a guide main body formed to have a C-shaped cross section having an upper wall part connecting and fixing paired front and rear side wall plate parts and upper end sides of the paired front and rear side wall plate parts and being provided with a guide passage where the feed plate passes between the paired side wall plate parts, a restriction groove provided to each of the paired front and rear side wall plate parts and having a slow movement groove provided to extend in a left-right direction along a direction of movement of the sliding door and a lock groove consecutively connected to the slow movement groove and having a stopper part, and a disk roller having a disk part and a shaft part longitudinally penetrating through a center of the disk part to be integrated with the disk part, with the shaft part being movably engaged inside the restriction grooves in a left-right direction and the disk part being placed to protrude inside the guide passage, and the feed plate includes a contact face which, when colliding with the disk part with a predetermined strength or more, moves the shaft part from inside of the slow movement groove to the stopper part of the lock groove to lock movement of the disk roller in the left-right direction and inhibit the feed plate from moving together with the sliding door to a closing side.

2. The safety device for the sliding door according to claim 1, wherein the contact face is formed as a tilted surface rising from a front side of a moving direction of the feed plate toward a rear side of the moving direction.

3. The safety device for the sliding door according to claim 1, wherein the slow movement groove of the restriction groove is formed as a slit-shaped groove, and the lock groove of the restriction groove is tilted at a predetermined angle from the opening side toward a closing side of the slow movement groove.

4. The safety device for the sliding door according to claim 1, wherein the stopper part restricts movement of the shaft part of the disk roller to the closing side of the sliding door.

5. The safety device for the sliding door according to claim 1, wherein the lock groove is formed as a long hole connected to the stopper part and as a curved surface swelling outside away from the slow movement groove.

6. The safety device for the sliding door according to claim 1, wherein the lock groove is formed to be as one of bifurcating branches including the slow movement groove.

7. The safety device for the sliding door according to claim 1, wherein the stopper part of the lock groove is formed in a step shape with respect to the slow movement groove.

8. The safety device for the sliding door according to claim 1, wherein the restriction groove includes a closing-direction end groove which lets the disk roller escape to a direction away from the feed plate when the feed plate is moved to a predetermined position with respect to the guide frame to allow movement of the feed plate further to a closing direction, and an opening-direction end groove which lets the disk roller escape to the direction away from the feed plate when the feed plate is returned to a predetermined position with respect to the guide frame to allow movement of the feed plate further to an opening direction.

9. The safety device for the sliding door according to claim 1, wherein the restriction groove includes a disk roller retreat groove which causes the disk roller to be retreated and retained outside the guide passage.

10. The safety device for the sliding door according to claim 1, wherein the paired front and rear side wall plate parts and the upper wall part of the guide main body are each formed as a separate body.

* * * * *